US006429392B1

(12) United States Patent
Bensley et al.

(10) Patent No.: US 6,429,392 B1
(45) Date of Patent: Aug. 6, 2002

(54) MAGNETIC BI-DIRECTIONAL SHOCK SENSOR

(75) Inventors: Martyn Bensley, Norfolk (GB); Marcel Briers, Borgloon (BE)

(73) Assignee: Breed Automotive Technology, Inc., Lakeland, FL (US)

( * ) Notice: Subject to any disclaimer, the term of this patent is extended or adjusted under 35 U.S.C. 154(b) by 282 days.

(21) Appl. No.: 09/603,603

(22) Filed: Jun. 26, 2000

(30) Foreign Application Priority Data

Jun. 29, 1999 (GB) ..... 9915018

(51) Int. Cl.[7] ..... H01H 35/14
(52) U.S. Cl. ..... 200/61.45 M
(58) Field of Search ..... 200/61.45 R, 61.45 M, 200/61.53; 335/205

(56) References Cited

U.S. PATENT DOCUMENTS 4,639,563 A * 1/1987 Gunther ..... 200/61.45 M
4,705,922 A 11/1987 Seeger et al. ..... 200/61.45 M
4,877,927 A * 10/1989 Reneau ..... 200/61.45 M
4,980,526 A * 12/1990 Reneau ..... 200/61.45 M
5,212,357 A * 5/1993 Reneau ..... 200/61.45 M
5,581,060 A 12/1996 Kobayashi et al. .. 200/61.45 M

FOREIGN PATENT DOCUMENTS

EP 0391582 A2 10/1990
GB 1421487 1/1976
WO WO 01/01433 A1 * 1/2001 ..... H01H/35/14

* cited by examiner

*Primary Examiner*—J. R. Scott
(74) *Attorney, Agent, or Firm*—Lonnie Drayer; Patrick Stiennon

(57) ABSTRACT

An acceleration-sensing mass/magnet is positioned about the center activation region of a reed switch. Motion of the acceleration-sensing magnet in either direction along the reed switch causes the reed switch to close. A first mechanism for sensing shock in a first direction is contained between a flange and a lid connected by a cylindrical wall. The flange and lid ride a plastic tube that contains the reed switch. The acceleration-sensing magnet travels between the flange and the lid on the tube. A second mechanism for sensing shock in a second opposed direction is formed by positioning a second mechanism about the magnet and the first mechanism. The second mechanism for sensing shock has a spring that biases the lid of the plastic sleeve against an abutment formed by a portion of a plastic capsule that encloses the entire shock sensor.

14 Claims, 4 Drawing Sheets

MAGNETIC BI-DIRECTIONAL SHOCK SENSOR

FIELD OF THE INVENTION

The present invention relates to shock sensors in general and to shock sensors employing reed switches in particular.

BACKGROUND OF THE INVENTION

Reed switches have found wide use in shock sensors, particularly as safing sensors in automobiles. Typically, automobile crash sensing is performed by integrated micro device sensors which are incorporated onto chips which assess the magnitude and direction of the crash and employ preprogrammed logic to decide whether and how to deploy or activate various safety systems. These systems include airbags and seat belt retractors. Such micro sensors can be very cost-effectively incorporated into a safety system's control logic. However, such small-scale devices are subject to electromagnetic interference and related phenomena giving rise to possible false sensor outputs.

Thus macro scale sensors are needed to provide a safing sensor which provides the programmed logic with an indication that a crash of sufficient magnitude to warrant activation of safety systems is in fact occurring. Shock sensors employing reed switches meet the need for a large-scale device while at the same time allowing a relatively small sized package that can be directly mounted onto a circuit board. A reed switch is resistant to electromagnetic interference and the hermetic seal formed by the glass capsule about the reeds results in a highly reliable switch which is sealed from the atmosphere. Thus, reed switch based shock sensors are usually the design choice for safing sensors forming part of a vehicle safety system.

Reed switch based shock sensors have been designed with multiple axes of sensitivity, yet such devices are typically considerably more expensive than unidirectional shock sensors or are more sensitive to large-scale vibration. A typical reed switch based shock sensor has an acceleration-sensing magnetic that is held against a stop by a spring. The spring is typically pre-loaded so that no motion of the sensing mass takes place unless the acceleration loads exceed a selected value. What is needed is a bi-directional shock sensor with variable pre-load in each of two opposed directions.

SUMMARY OF THE INVENTION

The shock sensor of this invention employs an acceleration-sensing mass/magnet that is positioned about the center activation region of a reed switch. Motion of the sensing mass in either direction along the reed switch causes the reed switch to close. The shock sensor attains bi-directional sensing by employing two nested mechanisms about a single acceleration-sensing magnet. The first mechanism for sensing shock in a first direction is contained within a plastic sleeve. The sleeve has an inwardly extending flange on one side, and a lid on the other side, with a connecting cylindrical wall. The sleeve flange and lid ride on a plastic tube that contains the reed switch. The flange of the plastic sleeve forms an abutment and a shock-sensing magnet is biased against the flange by a spring that extends between the magnet and the lid. A second mechanism for sensing shock in a second opposed direction is formed by nesting the second mechanism about the first mechanism so that the sensing mass/magnet is used to sense shocks in both directions. Thus bi-directional sensing is achieved by nesting a second unidirectional mechanism about a first unidirectional mechanism. The second mechanism for sensing shock employs a second spring that biases the lid of the plastic sleeve against an abutment formed by a portion of a plastic capsule that encloses the entire shock sensor. The plastic tube, reed switch, plastic sleeve and first and second springs are contained within the plastic capsule which isolates them from the environment. Pairs of leads are welded to both the reed switch leads and extend down from the plastic capsule to mount the shock sensor to a circuit board. A pair of leads for making continuity checks is mounted to the plastic capsule so that placement of the shock sensor on the circuit board can be verified.

It is a feature of the present invention to provide a bi-directional shock sensor wherein the sensitivity in each of two opposite directions can be a selectable design variable.

It is another feature of the present invention to provide a hermetically sealed bi-directional shock sensor.

It is a further feature of the present invention to provide a bi-directional shock sensor that can be closed or open in the non-accelerated mode.

Further features and advantages of the invention will be apparent from the following detailed description when taken in conjunction with the accompanying drawings.

DETAILED DESCRIPTION OF THE INVENTION

Figure 1:
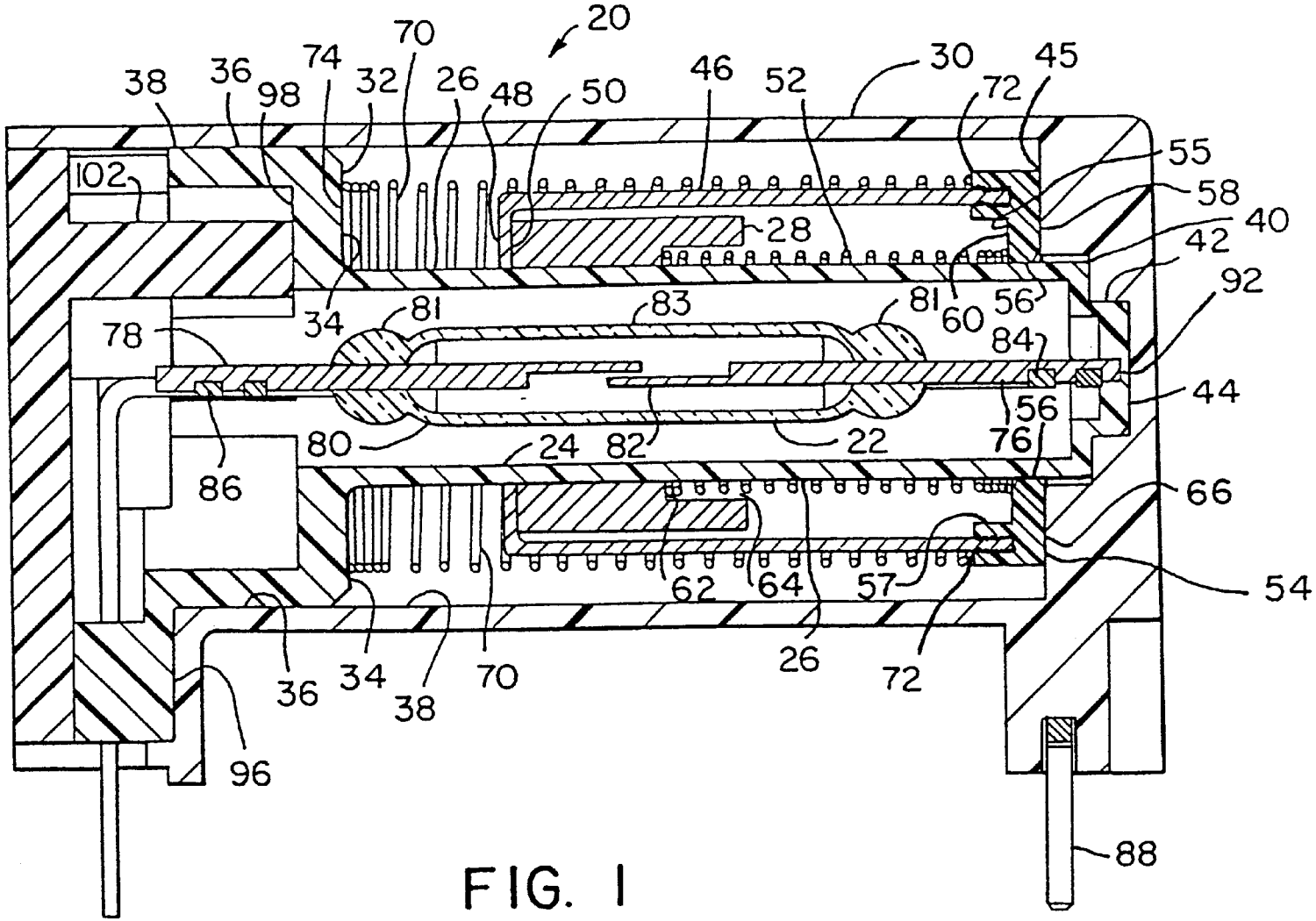
FIG. 1 is a side elevation cross-sectional view of the shock sensor of this invention.

Referring more particularly to FIGS. 1–4 wherein like numbers refer to similar parts, a bi-directional shock sensor 20 is shown in FIG. 1. The shock sensor 20 employs a reed switch 22 that is mounted in a plastic tube 24. The plastic tube has a cylindrical outside surface 26 on which a cylindrical magnet 28, which functions as an acceleration-sensing mass, is slidably mounted. Movement of the acceleration-sensing magnet along the cylindrical outside surface away from the central position shown in FIG. 1 results in the reed switch changing state. Movement of the acceleration-sensing magnet may cause the reed switch to open or to close, depending on the design of the acceleration-sensing magnet. The reed switch may be normally open or normally closed when the acceleration-sensing magnet is in the central position shown in FIG. 1. The acceleration-sensing magnet 28 is formed with a north-south, null, south-north arrangement of poles. This arrangement results in a normal reed switch being open when the acceleration-sensing magnet is centrally located and closed when the acceleration-sensing magnet moves in either direction along the reed switch. Other arrangements of poles may be possible including arrangements wherein the reed switch is normally closed which might have the arrangement of south-north null south-north.

Figure 3:
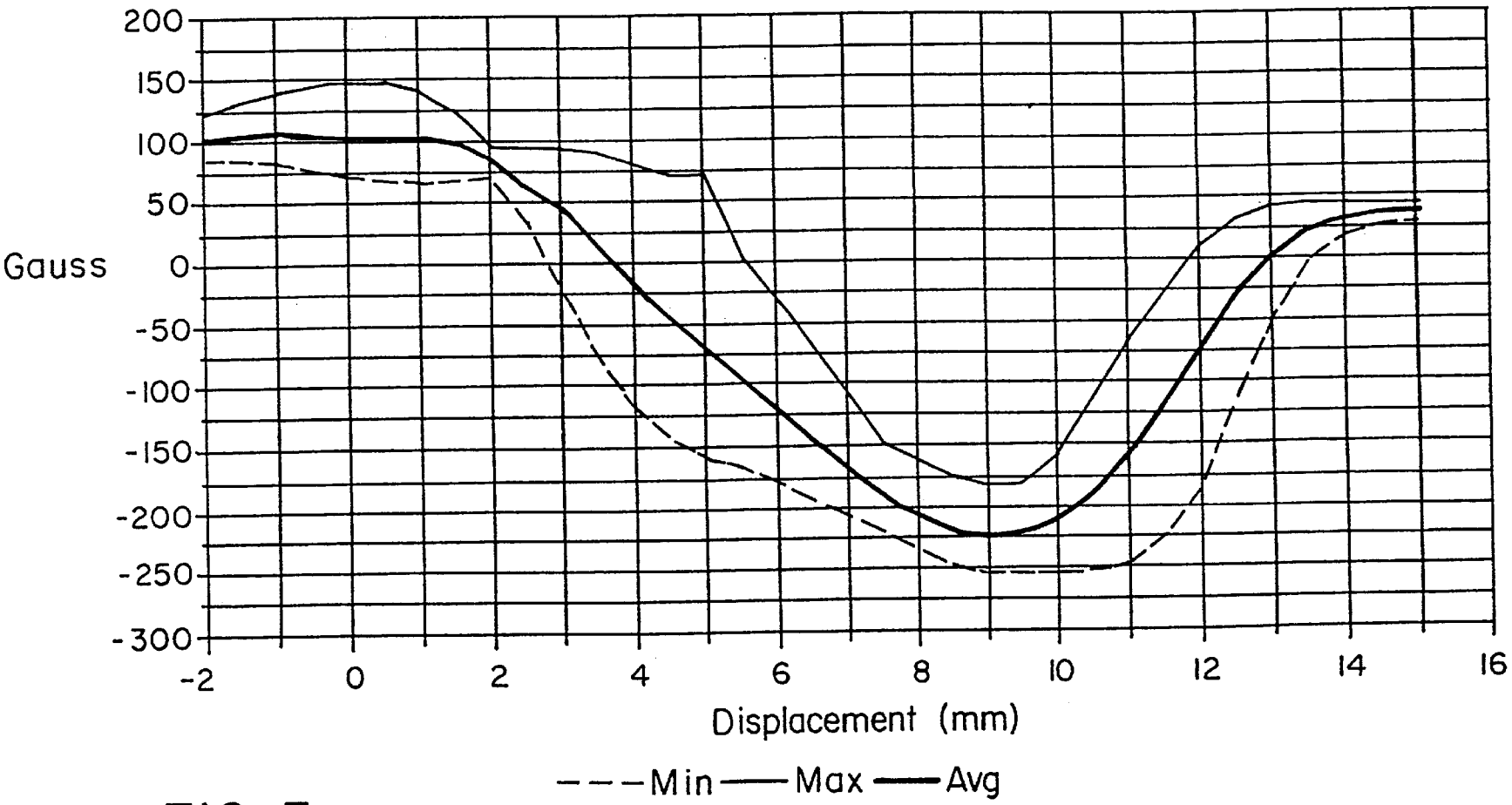
FIG. 3 is a chart of field strength, in Gauss, versus displacement, in millimeters, along the axis of the acceleration-sensing magnet in the shock sensing apparatus of FIG. 1.
Figure 4:
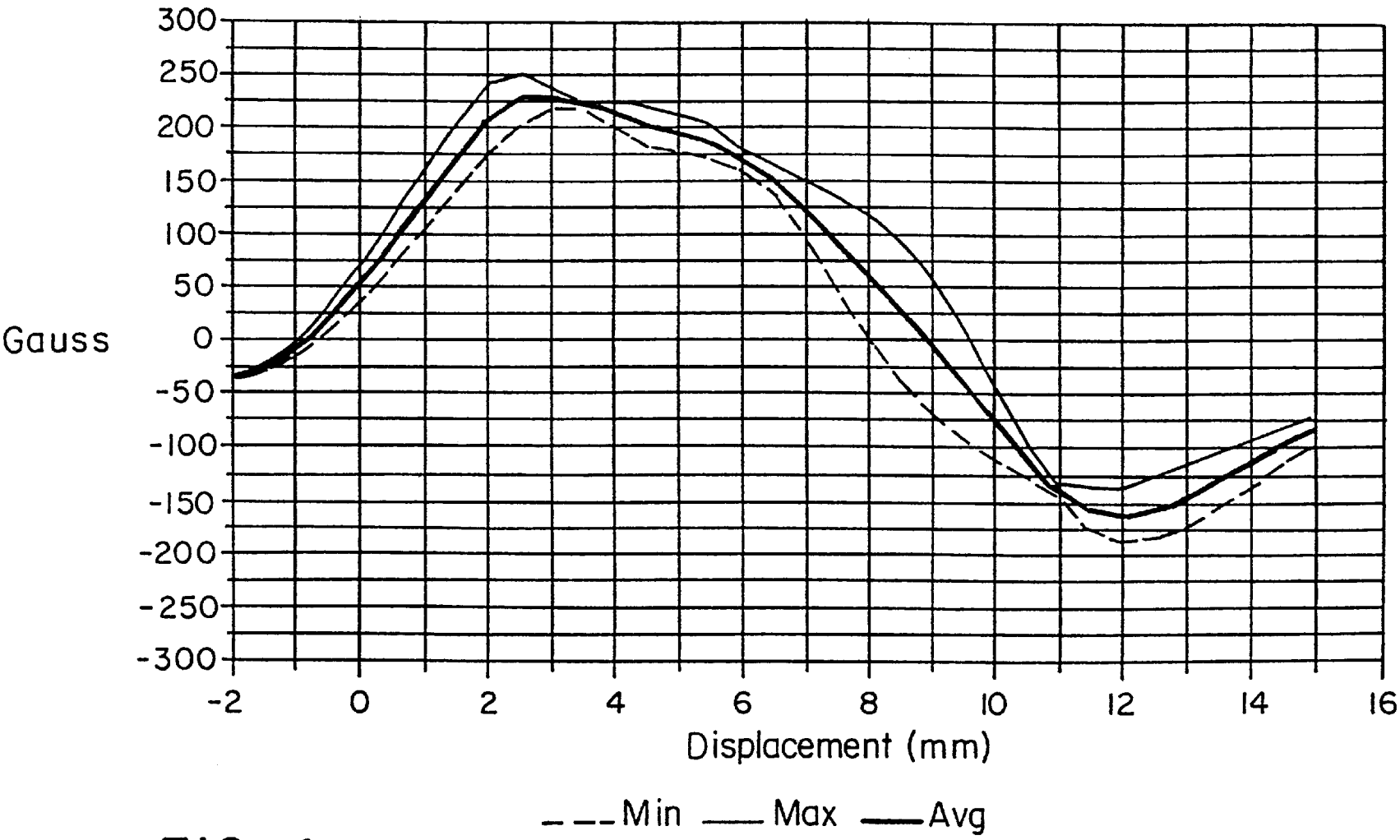
FIG. 4 is a chart similar to FIG. 3, but for a magnet which results in a normally closed reed switch.

In practice the magnetic profile of the acceleration-sensing magnet is complex and the foregoing description, while useful conceptually, is overly simplistic as shown in FIGS. 3 and 4, which provide a summary of actual magnetic profiles taken from test magnets. FIG. 3 shows field strength in Gauss versus displacement in millimeters along the axis of the acceleration-sensing magnet 28. Zero on the Y-axis corresponds to the front face of the magnet which abuts the first abutment 50, twelve millimeters corresponds to the face of the magnet 28 which faces the second abutment 55. The sensor used to generate the plot was moved along the axis of the magnet and readings were taken on either side of the magnet 28 to more completely define the magnetic field generated by the acceleration-sensing magnet 28.

FIG. 3 is based on the testing of five sample magnets and the upper line on the plot corresponds to maximum values, while the lower line corresponds to minimum values, and the thicker middle line corresponds to the average of the five samples. FIG. 4 is a plot based on two sample magnets and is similar to FIG. 3, but for a magnet which results in a normally closed reed switch. Magnets conforming to these plots can be purchased from Magnet Applications Limited, Northbridge road, Berkhamsted HP4 1EH, England.

The typical shock sensor of the type well known in the art employs a magnet which functions as a shock sensing mass. The acceleration-sensing magnet is positioned adjacent or about the reed switch and biased by a spring against a first abutment. A crash induced shock causes the acceleration-sensing magnet to move away from the first abutment towards a second abutment, and movement of the acceleration-sensing magnet relative to the reed switch causes closure of the reed switch.

The ability to pre-load the acceleration-sensing magnet against an abutment allows the shock sensor to be completely insensitive to shocks below a selected threshold. This pre-load feature also prevents sensitivity to vibrating loads below the threshold acceleration. Thus pre-load is an important design feature of shock sensors, which are employed to provide a mechanical macro scale check on micro-device shock sensors fabricated on an integrated circuit chip.

Typically to achieve bi-directional sensing, two shock sensors are required, or at least two shock sensing masses. The shock sensor 20, by employing a nesting arrangement which reuses the shock sensing magnet 28, allows the sensitivity and pre-load to be independently adjusted in each of the opposed shock sensing directions. Reuse of a magnet saves the cost of two separate magnets and results in a compact device.

The shock sensor 20 plastic tube 24 contains the reed switch 22 and fits within a plastic housing or capsule 30 which mounts the shock sensor 20 to a circuit board (not shown). The plastic tube 24 is positioned within the plastic capsule 30 by a cylindrical flange 32 which projects outwardly from the tube surface 26. The flange 32 has a radial surface 34 and an outside cylindrical surface 36. The cylindrical surface 36 engages an interior cylindrical surface 38 of the plastic capsule 30, forcing the plastic tube 24 to be coaxial with the interior cylindrical surface 38 of the plastic capsule 30.

The exterior of the plastic tube 24 has a closure end 40, shown in FIG. 1, which has a protruding radial step 42 which mates with a cylindrical stepped depression 44 in the radial surface 45 terminating the interior cylindrical surface 38 of the plastic capsule 30. The mating between the tube closure end 40 and the stepped depression 44 aides in aligning the plastic tube 24 and thus the reed switch 22 with the interior cylindrical surface 38 of the capsule 30.

The acceleration-sensing magnet 28 is contained within a plastic sleeve 46, to form the inner of two nested shock sensor mechanisms. The sleeve has an inwardly extending flange 48 that forms a first abutment 50 against which the magnet 28 is held by a first spring 52. The first spring 52 extends between the magnet and a closure or lid 54 which has a first radial surface 60 which forms a second abutment 55 which limits the travel of the acceleration-sensing magnet 28 under a shock-induced acceleration. The lid 54 is joined to the sleeve 46 by an ultrasonically welded joint 57.

The closure 54 extends radially inwardly to engage the plastic tube 24 with a cylindrical surface 56 which rides on the outside surface 26 of the plastic tube 24. The closure 54 has a second radial surface 58 which faces away from the acceleration-sensing magnet 28 and a first radial surface 60 which faces the magnet 28. The first spring 52 extends between a radial surface 62 formed in the magnet by a circumferential slot 64 and the radial surface 60 on the closure 54 which faces the acceleration-sensing magnet 28.

The plastic sleeve 46 together with the closure 54 and the acceleration-sensing magnet 28 and the spring 52 are slidable as a unit along the outside surface 26 of the plastic tube 24. The radial surface 58 of the closure which faces away from the acceleration-sensing magnet is biased against an abutment 66 formed by a radially extending surface 45 positioned about the step depression 44 of the plastic capsule 30 by a second spring 70. The second spring 70 extends between a radially extending lip 72 formed by the closure 54 and a radial surface 34 on the flange 32 of the plastic tube. The acceleration-sensing magnet 28 and the plastic sleeve 46 move together toward an abutment 74 formed by the radial surface 34 of the tube 24.

The first spring 52 controls the pre-load or minimum acceleration necessary to cause movement of the acceleration-sensing magnet 28 toward the second abutment 55. The second spring 70 controls the preload or minimum acceleration necessary to cause movement of the acceleration-sensing magnet toward the abutment 74. The actuation force in each of two opposed directions therefore can be independently controlled by adjusting the spring constants of the first and second springs 52, 70.

Figure 2:
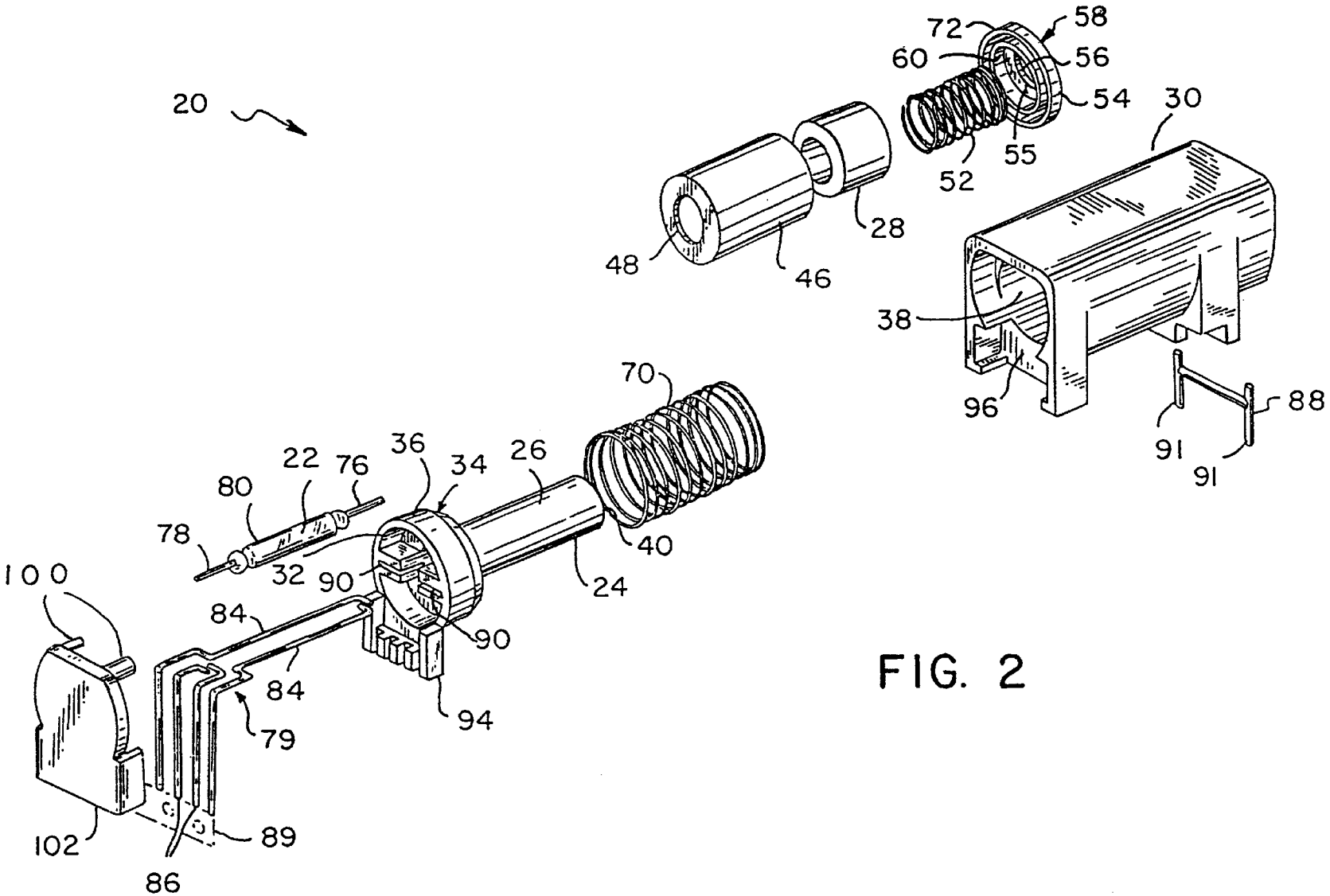
FIG. 2 is an exploded isometric view of the shock sensor of FIG.1.

As shown in FIG. 2, the reed switch 22 has a first ferromagnetic lead 76 and a second ferromagnetic lead 78 that extend through a glass capsule 80. The leads 76, 78 are formed into flexible overlapping reeds within the glass capsule 80. The reeds have overlapping ends 82. In the presence of a magnetic field the leads attract, causing the ends 82 to engage and forming a short circuit through the leads 76, 78. The glass capsule 80 has two ends 81 and a central region 83 approximately surrounding the overlapping reed ends 82.

The reed switch 22 is mounted to a leadframe 79 by welding the first lead 76 to a first pair of mounting leads 84, and by welding the second lead 78 to a second pair of mounting leads 86. The mounting leads 84, 86 are spot-welded to the reed switch leads 76, 78. Utilizing pairs of mounting leads substantially increases the reliability of the connections between the reed switch and the program logic used to deploy safety equipment. A tab 89 which holds the leadframe 79 together during assembly, is cut away after the shock sensor 20 is assembled. The mounting leads 84 are supported in slots 90 formed by support structures 87 which extend inwardly from the cylindrical portion of the flange 32.

An H-shaped continuity check leadframe 88 is received within the capsule 30. The continuity check leadframe 88 has two downwardly extending leads 91 that are connected by a short circuit. The leads 91 are used to connect two traces on a circuit board, thereby allowing detection of the presence of the shock sensor 20 that normally presents an open circuit.

Power usage is normally minimized and reliability improved by utilizing a shock sensor that indicates a crash event by closing a circuit. An electronic test of a circuit board on which the shock sensor is mounted cannot differentiate between a missing shock sensor and a normally open circuit formed by the shock sensor. The H-shaped continuity check leadframe 88 provides a means for determining the shock sensor presence, even when it is in an open condition.

The positioning of the reed switch 22 relative to the acceleration-sensing magnet 28 and the various abutments within the shock sensor 20 is critical. The leadframe 79 in cooperation with the leads 76, 78 positions the reed switch within the plastic tube 24. The slots 90 formed inside the flange 32 position the pair of mounting leads 84. The length of the first lead 76 controls the lateral position of the reed switch 22 by abutting a lead-accepting pocket 92 formed by portions of the closure 40 of the plastic tube 24.

The plastic tube 24 is positioned along a lower edge 93 by a mounting lead guide frame 94 that abuts an outwardly facing and downwardly extending surface 96 on the plastic capsule 30. The upper portion 98 of the plastic tube 24 is supported by projections 100 that extend from a cover 102.

The reed switch 22 and the acceleration-sensing magnet 28 and the springs 52, 70 are isolated from the environment within the plastic capsule 30 by potting a urethane potting, which fills in between the cover 102 and the flange 32 of the plastic tube 24.

It should be understood that the acceleration-sensing magnet may be made of ferric particles embedded in a nylon matrix. The tube 24 and the capsule 30 may be constructive of polyester. The springs 52, 70 may be constructed of stainless steel, the mounting leads may be constructed of nickel copper and the H-shaped continuity check leadframe 88 of brass which has been plated with 90/10 tin/lead solder.

It should be understood that a reed switch is caused to actuate, or close, when a magnetic field is present which causes the ferromagnetic reeds making up the switch to attract. A reed switch is generally considered to have a central activation region and an activation region at each end, because a magnet positioned adjacent these regions will cause the reed switch to close. However a magnet with several poles, particularly the arrangement of, north south, null, south north, located in the central activation region, can be designed to cause the reed switch to close when displaced in either direction. The critical problem solved by the bi-directional shock sensor 20 is that of providing a pre-load in two opposite directions and utilizing a single ferromagnetic acceleration-sensing mass.

It is understood that a null region in a ferromagnetic material is a region that is not magnetized.

While certain representative embodiments and details have been presented for the purpose of illustrating the invention, it will be apparent to those skilled in the art that various changes and modifications may be made therein without departing from the spirit and scope of the invention.

We claim:

1. A bi-directional shock sensor comprising:

a housing;

a reed switch mounted to the housing, the reed switch having a central region, and an end on either side of the central region, the reed switch defining an axial direction extending between the two ends;

an acceleration-sensing magnet incorporating at least two magnetic poles positioned adjacent to the central region of the reed switch;

a first spring pre-loading the acceleration-sensing magnet in a first direction against a first structure having portions forming a first stop;

a second spring pre-loading the first structure against portions of the housing forming a second stop, the second spring biasing the first structure in a second direction opposite the first direction to form a shock sensor;

wherein in response to an acceleration in the first direction the acceleration-sensing magnet moves and compresses the first spring; and wherein in response to an acceleration in the second direction the acceleration-sensing magnet and the first structure move and compress the second spring.

2. The bi-directional shock sensor of claim 1 wherein the acceleration-sensing magnet has four magnetic poles arranged in the axial direction, with a north, south, null, south, north arrangement.

3. The bi-directional shock sensor of claim 1 wherein the acceleration-sensing magnet is cylindrical and surrounds the reed switch.

4. The bi-directional shock sensor of claim 1, 2, or 3 wherein the first spring extends between the acceleration-sensing magnet and portions of the first structure defining a second stop on the first structure so that the acceleration-sensing magnet, the first spring, and the first structure move together against the second spring.

5. The bi-directional shock sensor of claim 3 wherein the reed switch is mounted within a plastic tube which is mounted to the housing, and wherein the first structure is a cylindrical plastic sleeve closed at one end by a flange which rides on the plastic tube, and closed at an opposite end by a closure in spaced parallel relation to the flange, the acceleration-sensing magnet being biased against the flange by the first spring which extends from the acceleration-sensing magnet to the closure.

6. The bi-directional shock sensor of claim 5 further comprising a first lead and second lead which extend from the housing and form a short circuit so the presence of the shock sensor may be detected on a circuit board.

7. A bi-directional shock sensor comprising:

a housing having an internal cylindrical cavity;

a reed switch mounted to a plastic tube, the plastic tube having a flange with a cylindrical surface which mates with the cylindrical cavity to position the plastic tube coaxial with the cylindrical surface;

an acceleration-sensing magnet, having a cylindrical shell shape, the acceleration-sensing magnet positioned to slide on the plastic tube;

a plastic sleeve surrounding the acceleration-sensing magnet, the plastic sleeve having a first abutment and a second abutment and a first spring positioned between the second abutment and the acceleration-sensing magnet to bias the acceleration-sensing magnet in a first direction against the first abutment, the plastic sleeve being positioned to slide on the plastic tube; and a second spring biasing the plastic sleeve in a second direction opposite the first direction.

8. The bi-directional shock sensor of claim 7 wherein the acceleration-sensing magnet has four magnetic poles arranged in the axial direction with a north, south, null, south, north arrangement.

9. The bi-directional shock sensor of claim 7 further comprising a first lead and a second lead which extend from the housing and which form a short circuit so the presence of the shock sensor may be detected on a circuit board.

10. A bi-directional shock sensor comprising:

a housing;

a reed switch mounted on the housing;

a first structure mounted for sliding engagement within the housing;

a first spring biasing the first structure in a first direction against a portion of the housing;

an acceleration-sensing magnet mounted within the first structure for movement from a first abutment on the first structure towards a second abutment on the first structure; and a second spring biasing the acceleration-sensing magnet against the first abutment in a direction opposite the first direction, wherein the acceleration-sensing magnet within the first structure senses acceleration in a first direction, and wherein the acceleration-sensing magnet resting against the first abutment moves with the first structure to sense acceleration in a second direction.

11. The bi-directional shock sensor of claim 10 wherein the acceleration-sensing magnet has four magnetic poles arranged in the axial direction with a north, south, null, south, north arrangement.

12. The bi-directional shock sensor of claim 10 wherein the acceleration-sensing magnet is cylindrical and surrounds the reed switch.

13. The bi-directional shock sensor of claim 12 wherein the reed switch is mounted within a plastic tube which is mounted to the housing, and wherein the first structure is a cylindrical plastic sleeve closed at one end by a flange which rides on the plastic tube, and closed at an opposite end by a closure in spaced parallel relation to the flange, the acceleration-sensing magnet being biased against the flange by the second spring which extends from the acceleration-sensing magnet to the closure.

14. The bi-directional shock sensor of claim 12 further comprising a first lead and a second lead which extends from the housing forming a short circuit so the presence of the shock sensor may be detected on a circuit board.

* * * * *